US010856568B2

(12) United States Patent
Huang

(10) Patent No.: US 10,856,568 B2
(45) Date of Patent: Dec. 8, 2020

(54) INHALATION DEVICE WITH HEATING, STIRRING AND LEAK PREVENTING COMPONENTS

(71) Applicant: Yao Tien Richard Huang, Fremont, CA (US)

(72) Inventor: Yao Tien Richard Huang, Fremont, CA (US)

( * ) Notice: Subject to any disclaimer, the term of this patent is extended or adjusted under 35 U.S.C. 154(b) by 188 days.

(21) Appl. No.: 15/592,452

(22) Filed: May 11, 2017

(65) Prior Publication Data

US 2017/0245546 A1 Aug. 31, 2017

Related U.S. Application Data

(63) Continuation-in-part of application No. 15/040,622, filed on Feb. 10, 2016, now abandoned.

(51) Int. Cl.

| | |
|---|---|
| ***A24F 47/00*** | (2020.01) |
| ***A24F 1/16*** | (2006.01) |
| ***A24F 1/00*** | (2006.01) |
| ***H05B 3/04*** | (2006.01) |
| ***H05B 3/44*** | (2006.01) |
| *A24F 1/30* | (2006.01) |

(52) U.S. Cl.

CPC ..... *A24F 1/16* (2013.01); *A24F 1/00* (2013.01); *A24F 47/008* (2013.01); *H05B 3/04* (2013.01); *H05B 3/44* (2013.01); *A24F 1/30* (2013.01); *H05B 2203/021* (2013.01); *H05B 2203/022* (2013.01)

(58) Field of Classification Search

None

See application file for complete search history.

(56) References Cited

U.S. PATENT DOCUMENTS

| | | | | |
|---|---|---|---|---|
| 4,029,109 | A * | 6/1977 | Kahler | A24F 1/30 131/173 |
| 7,997,280 | B2 | 8/2011 | Rosenthal | |
| 2011/0126831 | A1 | 6/2011 | Fernandez Pernia | |
| 2014/0326257 | A1* | 11/2014 | Jalloul | A24D 1/14 131/226 |
| 2015/0013699 | A1* | 1/2015 | Ellis | A24F 47/008 131/329 |
| 2015/0020833 | A1 | 1/2015 | Conley et al. | |
| 2015/0040928 | A1 | 2/2015 | Saydar et al. | |
| 2015/0257443 | A1* | 9/2015 | Rado | A24F 47/00 392/390 |

* cited by examiner

*Primary Examiner* — Michael H. Wilson
*Assistant Examiner* — Katherine A Will
(74) *Attorney, Agent, or Firm* — Olav M. Underdal; IDP Patent Services

(57) ABSTRACT

A device including a water chamber for filtering smoke or vapor prior to inhalation of the smoke or vapor. The device including a vaporization chamber that contains a substance to be heated or burned. The device including an air flow chamber, herein the air flow chamber connects the vaporization chamber, wherein the air flow chamber is configured to provide a tunnel between an upper edge and a lower edge of the air flow chamber, for passage of air/vapor from an air/vapor entry port to a filtered air exit port for air/vapor at the water chamber, in a snake like manner; wherein the air/vapor entry port is located at a point where the vaporization chamber is joined to the water chamber. The air flow chamber is configured to prevent leakage of water from the water chamber to the vaporization chamber.

19 Claims, 8 Drawing Sheets

INHALATION DEVICE WITH HEATING, STIRRING AND LEAK PREVENTING COMPONENTS

CROSS-REFERENCE TO RELATED APPLICATIONS

The present continuation-in-part patent application claims priority benefit under 35 U.S.C. 120 of the U.S. nonprovisional patent application Ser. No. 15/040,622 entitled "INHALATION DEVICE WITH HEATING, STIRRING AND LEAK PREVENTING COMPONENTS" filed 10 Feb. 2016. The contents of this related patent application is incorporated herein by reference for all purposes to the extent that such subject matter is not inconsistent herewith or limiting hereof.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to inhalation devices. More particularly, the invention relates to an inhalation device comprising enhanced means for heat distribution, air flow for direct burn, vaporization of material in the inhalation device, and for leak prevention.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. Currently there are many types of inhalation devices available for the vaporization and direct burning of herbs and other substances such as, but not limited to, wax and oil. A main difference between vaporizing and direct burning is that is during vaporization, the heating temperature is typically lower than in direct burning and usually the heated air travels through the substance being vaporize to melt the active ingredients. During vaporization, the heat source typically does not touch the substance, and if the heat source does touch the substance, the temperature of the heat source is usually not hot enough to enable combustion to occur. In a direct burning or smoking device, the heat source may directly touch the substance, and combustion often occurs. Current vaporizers and direct burning devices typically require the herbs to be grinded to a very fine state to allow for proper exposure to heat. It is believed that even when the herbs are grinded properly uneven heat distribution may occur due to a variety of factor such as, but not limited to, how the herbs were packed, the volume of herbs used, the shape of the burning surface, etc. These vaporizers and direct burning devices usually heat from the bottom, which may mean that only the lower layers of the herbs may be vaporized or burned.

By way of educational background, another aspect of the prior art generally useful to be aware of is that current vaporization or direct burn may often leave the vaporized or burned air very dry and hot, which may be unsuitable for prolong usage and may result in higher quantity of undesirable substance to be inhaled. Water filtration has been one of the oldest forms of the filtration system used during smoking to resolve both issues. It filters out the undesirable substances and cools and moisturizes the air that is being inhaled. Current solution for vaporization typically may include an add on mouthpiece that is filled with water to be attached to vaporizers and direct burning device. Such devices, especially in an electronic vaporizer setting may provide 1) a separate attachment, which requires separate protection during carrying, 2) may only be used after the separate attachments are assembled and each time has to be disassembled and 3) the assembled device with both water filtration and vaporizer may not be carriable, e.g., the user carrying it risks spilling out the water so typically dumps out the water after each use, then refills to setup again for later use.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A is a side perspective view of the direct burning device, and FIG. 2B is a diagrammatic side view of heating element;

FIG. 5A illustrates front perspective views of the water filtered inhalation device. FIG. 5B is a front perspective view and a cut out view of the air flow chamber. FIG. 5C illustrates a perspective view showing the working of the airflow chamber, and FIG. 5D illustrates a perspective view showing the working of the airflow chamber.

Figure 1:
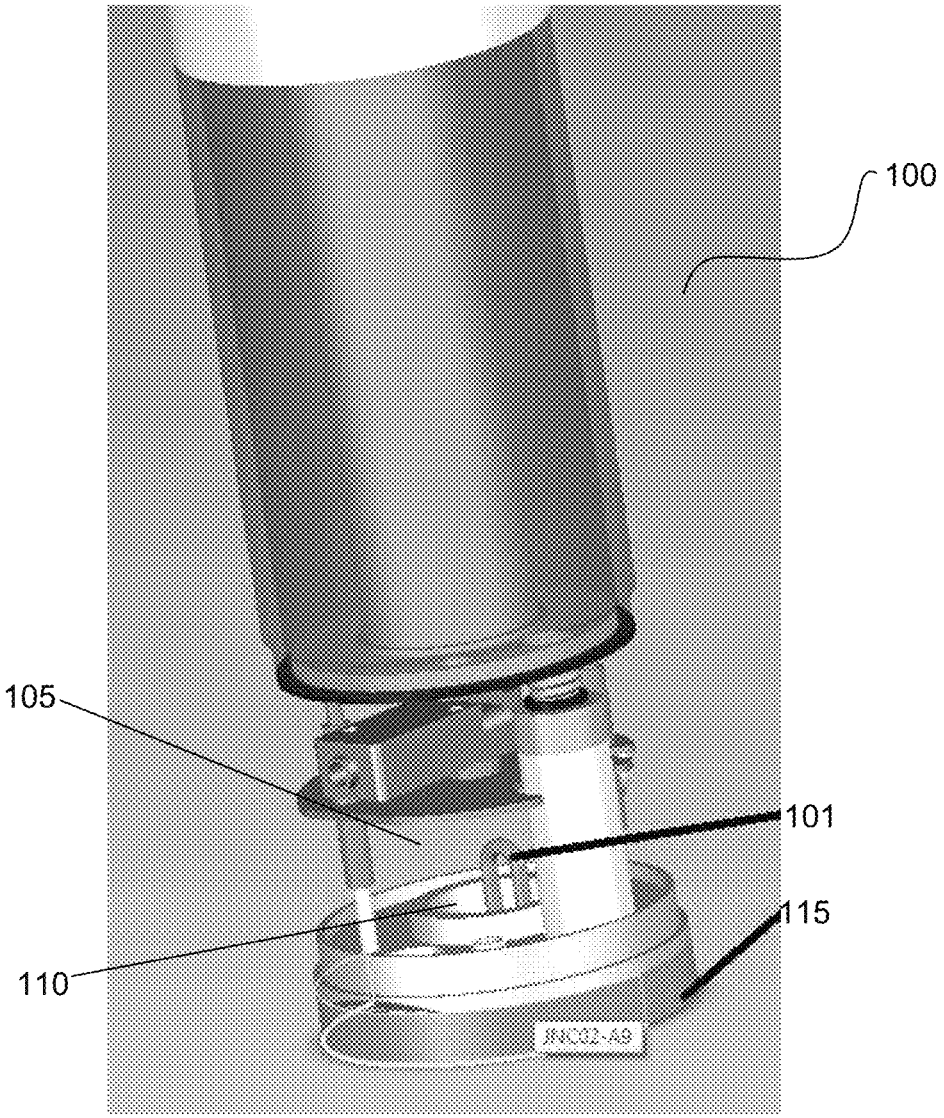
FIG. 1 is a side perspective view of an exemplary vaporizing device with a stirring component, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see *Ex parte Mallory,* 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See *Energy Absorption Sys., Inc.* v. *Roadway Safety Servs., Inc., Civ. App.* 96-1264, slip op. at 10 (Fed. Cir. Jul. 3, 1997) (unpublished) *Hybridtech* v. *Monoclonal Antibodies, Inc.,* 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See *Seattle Box Co.* v. *Industrial Crating & Packing, Inc.,* 731 F.2d 818, 828-29, 221 *USPQ* 568, 575-76 (Fed. Cir. 1984).

Moreover, the ordinary and customary meaning of terms like "substantially" includes "reasonably close to: nearly, almost, about", connoting a term of approximation. See In re *Frye, Appeal No.* 2009-006013, 94 USPQ2d 1072, 1077, 2010 WL 889747 (B.P.A.I. 2010) Depending on its usage, the word "substantially" can denote either language of approximation or language of magnitude. *Deering Precision Instruments, L.L.C.* v. *Vector Distribution Sys., Inc.,* 347 F. 3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). The ordinary meaning of "substantially halfway" is thus reasonably close to or nearly at the midpoint between the forwardmost point of the upper or outsole and the rearwardmost point of the upper or outsole.

Similarly, the term "substantially" is well recognized in case law to have the dual ordinary meaning of connoting a term of approximation or a term of magnitude. See *Dana Corp.* v. *American Axle & Manufacturing, Inc., Civ. App.* 04-1116, 2004 U.S. App. LEXIS 18265, *13-14 (Fed. Cir. Aug. 27, 2004) (unpublished). The term "substantially" is commonly used by claim drafters to indicate approximation. See *Cordis Corp.* v. *Medtronic AVE Inc.,* 339 F.3d 1352, 1360 (Fed. Cir. 2003) ("The patents do not set out any numerical standard by which to determine whether the thickness of the wall surface is 'substantially uniform'. The term 'substantially,' as used in this context, denotes approximation. Thus, the walls must be of largely or approximately uniform thickness."); see also *Deering Precision Instruments, LLC* v. *Vector Distribution Sys., Inc.,* 347 F.3d 1314, 1322 (Fed. Cir. 2003); *Epcon Gas Sys., Inc.* v. *Bauer Compressors, Inc.,* 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, *Liquid Dynamics Corp.* v. *Vaughan Co.,* 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In *Cordis Corp.* v. *Medtronic AVE, Inc.,* 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In *Anchor Wall Systems* v. *Rockwood Retaining Walls, Inc.,* 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see *Deering Precision Instruments, L.L.C.* v. *Vector Distrib. Sys., Inc.,* 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see *Epcon,* 279 F.3d at 1031 ("The phrase 'substantially constant' denotes language of approximation, while the phrase 'substantially below' signifies language of magnitude, i.e., not insubstantial."). Also, see, e.g., *Epcon Gas Sys., Inc.* v. *Bauer Compressors, Inc.,* 279 F.3d 1022 (Fed. Cir. 2002) (construing the terms "substantially constant" and "substantially below"); *Zodiac Pool Care, Inc.* v. *Hoffinger Indus., Inc.,* 206 F.3d 1408 (Fed. Cir. 2000) (construing the term "substantially inward"); *York Prods., Inc.* v. *Cent. Tractor Farm & Family Ctr.,* 99 F.3d 1568 (Fed. Cir. 1996) (construing the term "substantially the entire height thereof"); *Tex. Instruments Inc.* v. *Cypress Semiconductor Corp.,* 90 F.3d 1558 (Fed. Cir. 1996) (construing the term "substantially in the common plane"). In conducting their analysis, the court instructed to begin with the ordinary meaning of the claim terms to one of ordinary skill in the art. *Prima Tek,* 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see *AK Steel Corp.* v. *Sollac,* 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by *Pall Corp.* v. *Micron Separations, Inc.,* 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see *Verve LLC* v. *Crane Cams Inc.,* 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In *Andrew Corp.* v. *Gabriel Elecs. Inc.,* 847 *F.2d* 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in *Ecolab Inc.* v. *Envirochem, Inc.,* 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see *Ecolab Inc.* v. *Envirochem Inc.,* 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see *Pall Corp.* v. *Micron Seps.,* 66 F.3d 1211, 1217, 36 USPQ2d 1225, 1229 (Fed. Cir. 1995); see, e.g., *Andrew Corp.* v. *Gabriel Elecs. Inc.,* 847 *F.2d* 819, 821-22, 6 USPQ2*d* 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see *Ex parte Mallory,* 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re *Hutchison,* 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present application or of any further application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, are generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology

The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn. 112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter. Moreover, for any claim of the present invention which claims an embodiment "consisting essentially of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of" where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide means for improving heat distribution and air flow for direct burning and/or vaporization of herbs or other substances. In some embodiments, a built in stirring component may be provided to agitate a substance being heated, burned or vaporized for uniform heat distribution. Some embodiments may comprise a vertical heating element that projects from a bottom burning surface to add heat from the bottom heating surface through the middle of a substance being vaporized or burned, which may help to ensure that the bottom, middle and top of the substance may all be exposed to a vaporizing surface or a direct burning surface. In some embodiments, the airflow through a vaporization, heating or direct burning device may flow through a one-way valve, which may trap heated vapor or smoke to help eliminate waste and improve air inflow. In some embodiments, a U-shaped tube may prevent water from escaping from a filtering chamber.

FIG. 1 is a side perspective view of an exemplary vaporizing device 100 with a stirring component 101, in accordance with an embodiment of the present invention. In the present embodiment, vaporizing device 100 comprises an enclosed vaporizing chamber 105 with a heating compartment 110 to hold and heat the substance being vaporized. Referring to FIG. 1, vaporizing chamber 105 is shown without an enclosure for illustration purposes. Stirring component 101 may be located in heating compartment 110. An externally reachable actuator 115 may be attached to stirring component 101 so that when actuator 115 is turned or otherwise put into action stirring component 101 may move thus rearranging the substance being vaporized within heating compartment 110 for more even heat distribution. In the present embodiment, stirring component 101 may be a U-shaped hook that may be connected to actuator 115, which may be a rotating bottom portion of vaporizing device 100, so that stirring component 101 may turn when actuator 115 is turned. It is contemplated that various different types of external actuators may be implemented in some embodiments including, without limitation, knobs that may be turned to turn the stirring component, levers that may be used to move the stirring component in a back and forth motion, a button for moving the stirring component in an up and down motion, indentation for finger placement that may be rotated in a circular fashion to rotate the stir, etc. Furthermore, those skilled in the art will readily recognize, in light of and in accordance with the teachings of the present invention, that the stirring components in some embodiments may have a multiplicity of suitable shapes other than a U-shape such as, but not limited to, spoon shaped stirring components, stirring rods, screw shaped stirring components, coil shaped stirring components, etc. In other embodiments the entire heating compartment may turn to typically enable the substance within the compartment to be turned rather than stirred. Some embodiments may include means for causing the stirring component to be electronically actuated, for example, without limitation, by a small motor that may be turned on or off by a switch or button on the outside of the vaporization device. Some embodiments may also provide means for automatic stirring such as, but not limited to, a motor that automatically stirs the substance being vaporized at preset intervals.

In typical use of the present embodiment, the connection between stirring component 101 and external actuator 115 may typically enable stirring component 101 to turn when actuator 115 is turned. The turning of stirring component 101 may cause any substance within heating compartment 110 to be stirred and redistributed throughout heating compartment 110 so that different portions of the substance in heating compartment 110 may be near a heating source in heating compartment 110. Similarly to cooking in a pot, during vaporization the stirring of the substance being vaporized may allow for even heat distribution. Currently available approaches may not include means for stirring the substance being vaporized as these devices usually vaporize the substance in a closed chamber. An aspect of the present embodiment is to allow the herbal substance to be vaporized in an enclosed environment while also providing means for stirring the substance within this enclosed environment during the vaporization process. It is believed that by providing even heat distribution, the present embodiment may increase the vaporizing speed.

Figure 2A:
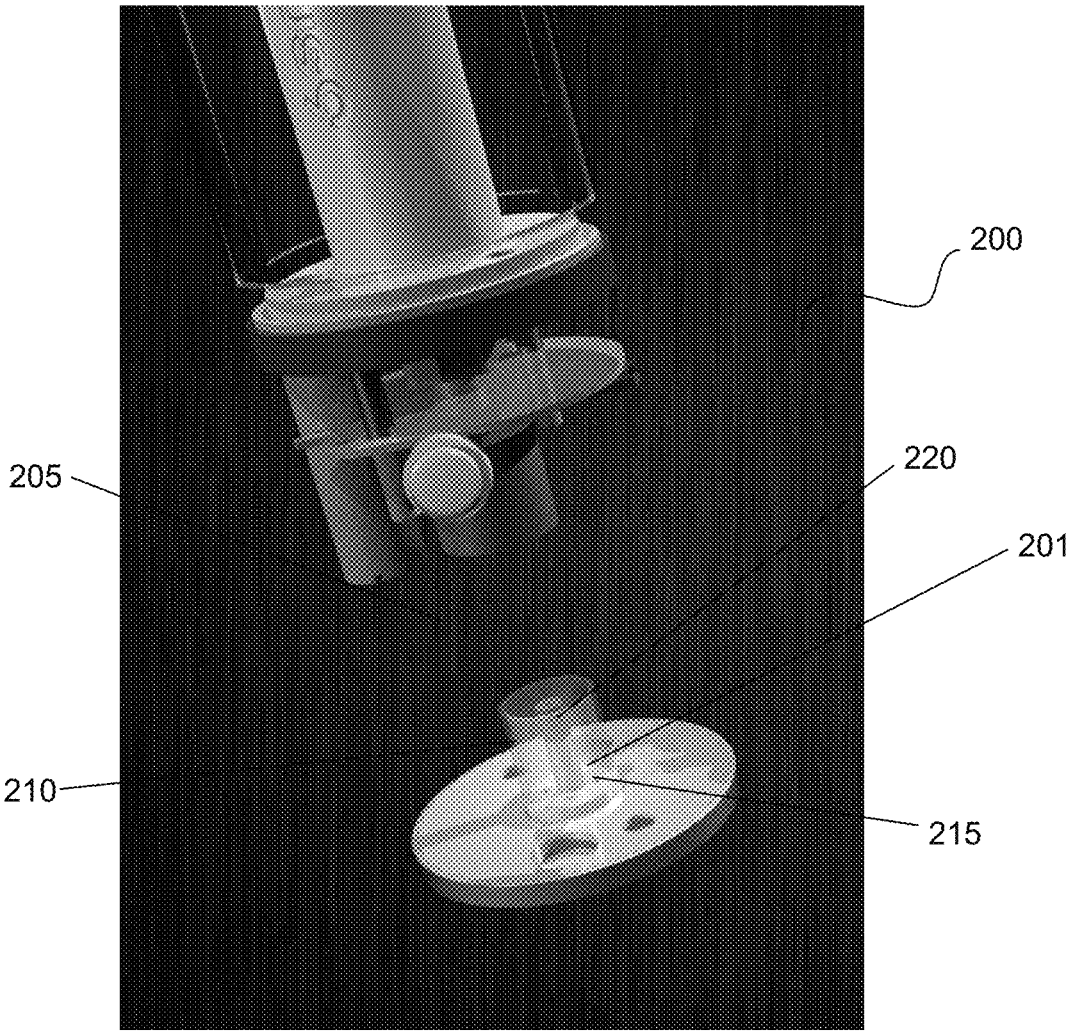
FIGS. 2A and 2B illustrate an exemplary three dimensional heating element for a direct burning device with, in accordance with an embodiment of the present invention.
Figure 2B:
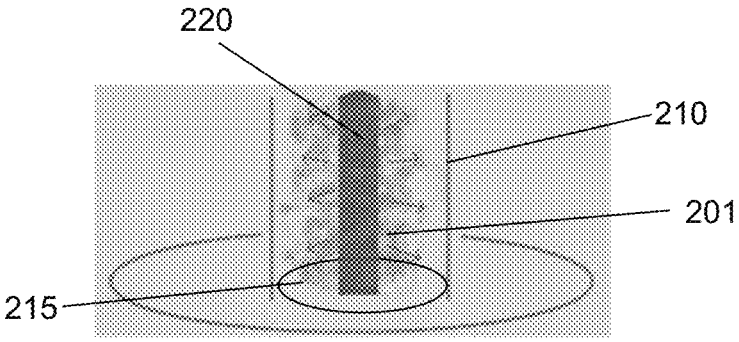

FIGS. 2A and 2B illustrate an exemplary three dimensional heating element 201 for a direct burning device 200, in accordance with an embodiment of the present invention. FIG. 2A is a side perspective view of direct burning device 200, and FIG. 2B is a diagrammatic side view of heating element 201. In the present embodiment, direct burning device 200 comprises an enclosed burning or containment chamber 205 with a heating surface area or burning compartment 210 to hold and heat or burn the substance. Referring to FIG. 2A, burning chamber 205 is shown without an enclosure for illustration purposes. Heating element 201 comprises a flat heating base plate 215 at the bottom of burning compartment 210 and a heating rod 220 extending through the middle of heating surface area or burning compartment 210. Referring to FIG. 2B, the combination of flat heating base plate 215 and heating rod 220 typically provides more heating surface area than a base plate alone and may allow heat from heating element 201 to simultaneously be provided from the bottom of burning compartment 210 and through the middle of the substance being heated or burned within burning compartment 210.

In the present embodiment, heating base plate 215 and heating rod 220 may be made of metal as metal typically provides effective heat conductivity. It is contemplated that a variety of other heat conducting materials may be used in some alternate embodiments including, without limitation, ceramic materials, porcelain, some natural stone, etc. In the present embodiment, heating base plate 215 and heating rod 220 may be configured to heat up completely rather than through the use of a heating coil within heating element 201, which may help to prevent any blind spots in heating element 201. In the present embodiment, heating element 201 may be connected to a heat source such as, but not limited to, a battery, by which heat may be transferred to heating element 201 so that base plate 215 and/or heating rod 220 may be heated until glowing red to typically enable combustion of the substance within burning compartment 210. The battery would provide heating energy through conductive metal plates located on the base plate. Conductive metal plates will transfer the electricity to coils within the heating rod 220 and/or the heating plate 215 and will be heated from the coils within. Other external heating source may include but are not limited to propane, or ultra-sonic generated heating source. It is contemplated that some embodiments may be heated to lower temperatures to enable a three dimensional heating element to be used in a vaporizing device rather than a direct burning device. Alternate embodiments may use various different means for heating the heating element such as, but not limited to, heating coils within the base and heating rod or by forming a heating coil into the shape of a flat base and vertically extending rod. Another contemplated embodiment includes but not limited to ball shape 360-degree heating via coils inside the heating element.

It is contemplated that a multiplicity of suitable designs may be used for the heating element to provide heat throughout the substance being burned other than a flat base and vertical rod. For example, without limitation, in some embodiments, the heating element may comprise a cone shape or a flat base with multiple vertical rods. Other embodiments may implement heating elements that provide heat from the bottom, middle, and also the top of the burning compartment. Yet other embodiments may comprise heating elements that provide heat from the bottom and/or the top of the burning compartment as well as around the outside surface of the burning compartment. These embodiments may or may not comprise one or more heating rods through the middle of the burning compartment. In one such embodiment the burning compartment may be implemented as a sphere in which the entire surface area may conduct heat to the substance being burned. Another embodiment could be of a circular ball shape compartment which the substance inside are receiving heat from all directions. What is to be considered is the structure of the material being vaporized or burned. If the substance is in liquid format, then perhaps it requires an enclosed compartment. Or if the substance consists of solid form which air holes would need to be designed in the burning compartment to allow for air flow.

In typical use of the present embodiment, the size and shape of the burning surface area of heating element 201, particularly heating rod 220 through the middle of burning compartment 210, may provide excellent heat distribution throughout the substance being burned. It is believed that in current direct burning devices, which typically utilize heat sources that only heat the substance being burned from the bottom, heat may not travel efficiently from the bottom of the substance to the top. This may cause the bottom layers of the substance to be completely burned while the top layers may be practically untouched. An aspect of the present embodiment may be to allow the direct burning of a substance to happen from the bottom up from heating base plate 215 and from the middle outward from heating rod 220 typically ensuring that the bottom, middle, and top of the substance being burned are effectively exposed to the surface area of heating element 210. It is also contemplated that this enhanced heat distribution may lead to increased burning speed.

Those skilled in the art will readily recognize, in light of and in accordance with the teachings of the present invention, that some embodiments may comprise both a three dimensional heating element, as illustrated by way of example in FIGS. 2A and 2B, and a stirring component, as illustrated by way of example in FIG. 1. These embodiments may provide enhanced heat distribution through the increased surface area of the heating element and may enable a user to further enhance heat distribution through the ability to stir the substance being burned or vaporized. These embodiments may be configured for vaporizing applications as well as direct burning applications.

Figure 3:
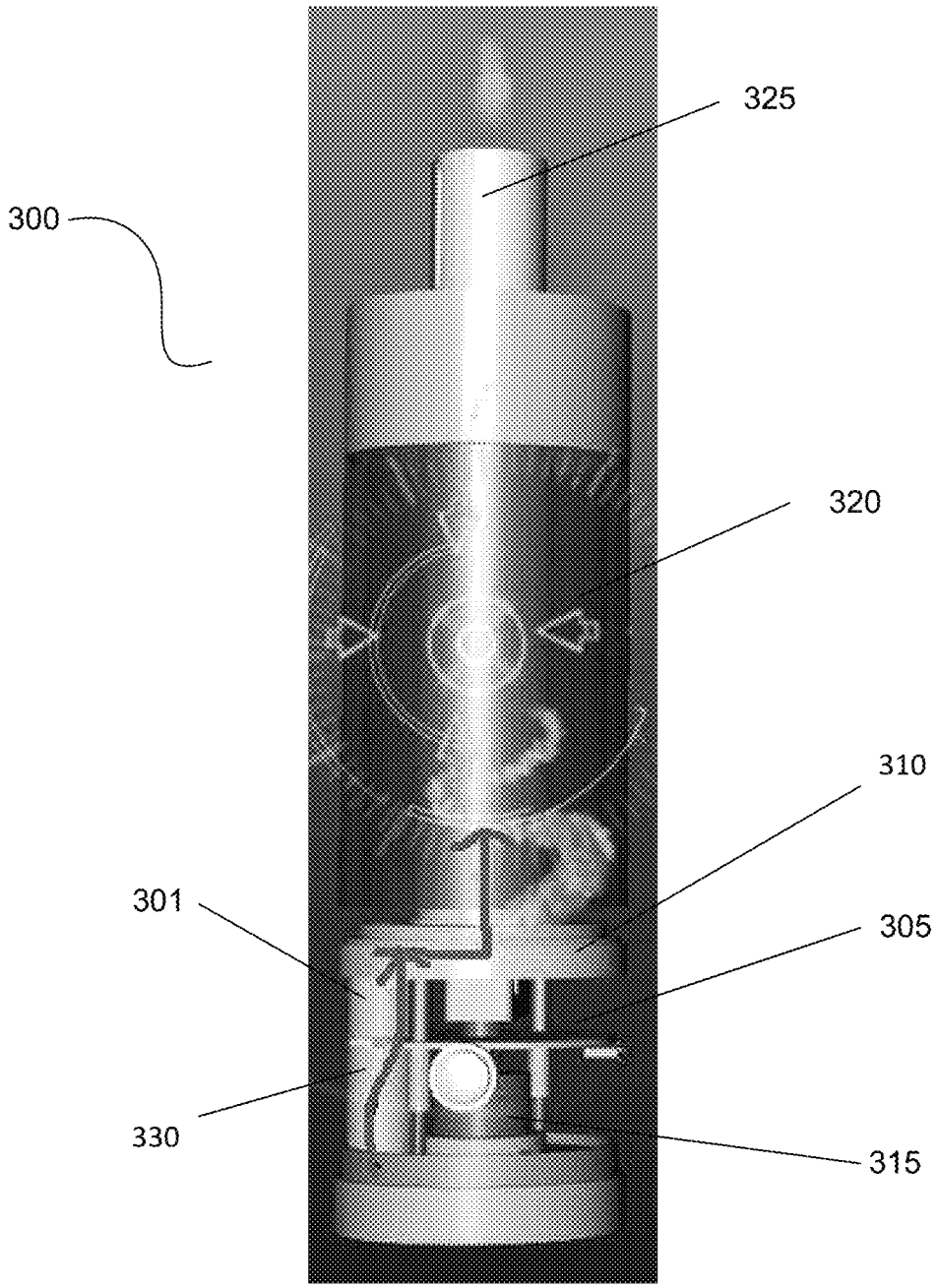
FIG. 3 is a diagrammatic side view of an exemplary inhalation device comprising a one-way valve, in accordance with an embodiment of the present invention.

FIG. 3 is a diagrammatic side view of an exemplary inhalation device 300 comprising a one-way valve 301, in accordance with an embodiment of the present invention. Inhalation device 300 may be configured as a vaporizing device or a direct burn device. In the present embodiment, inhalation device 300 may enable incoming air to enter vaporizing or burning chamber 305 through a horizontal air duct 310 above vaporizing or burning chamber 305 to assist in the burning of the substance. Vaporizing or burning chamber 305 is an enclosed chamber. However, vaporizing or burning chamber 305 is shown by way of example in FIG. 3 without an enclosure for illustration purposes. The air then travels downward within vaporizing or burning chamber 305 to a heating or burning compartment 315. Then the air, along with smoke or vapor from heating or burning compartment 315, may travel up, as shown by arrow 330.

During the inhalation process of any vaporizer or direct burning device, a user typically takes breaks between each inhalation. Current devices may not include means to trap the vapor or smoke after burning or vaporization and some vapor or smoke may escape during the process, particularly between inhalations. An aspect of the present embodiment is to trap the vapor or smoke in vaporizing or burning chamber 305 to help eliminate waste. In typical use of the present embodiment, one-way valve 301 may enable air along with vapor or smoke to pass through into chamber 320 when a user inhales from a top mouthpiece 325. Typically, the pressure from inhalation causes air to travel from the bottom to the top of valve 301 and may cause a rubber or silicone stopper inside one-way valve 301 to open, which allows air to travel through valve 301. When air is not being inhaled, or traveling from bottom to top, the stopper is normally in a closed position and typically preventing vapor or smoke from escaping to the vaporizing or burning chamber 305 between inhalations. Some embodiments may have water or another type of liquid in sealed chamber 320 to provide a filtration and cooling system for the vapor or smoke being inhaled. If liquid is present in chamber 320, one-way valve 301 may also help to prevent the liquid from leaking from chamber 320 into vaporizing or burning chamber 305. Some alternate embodiments may also comprise a one-way valve near the mouthpiece to trap the smoke or vapor in the sealed chamber above the vaporizing or burning chamber that may remain between inhalations.

Figure 4:
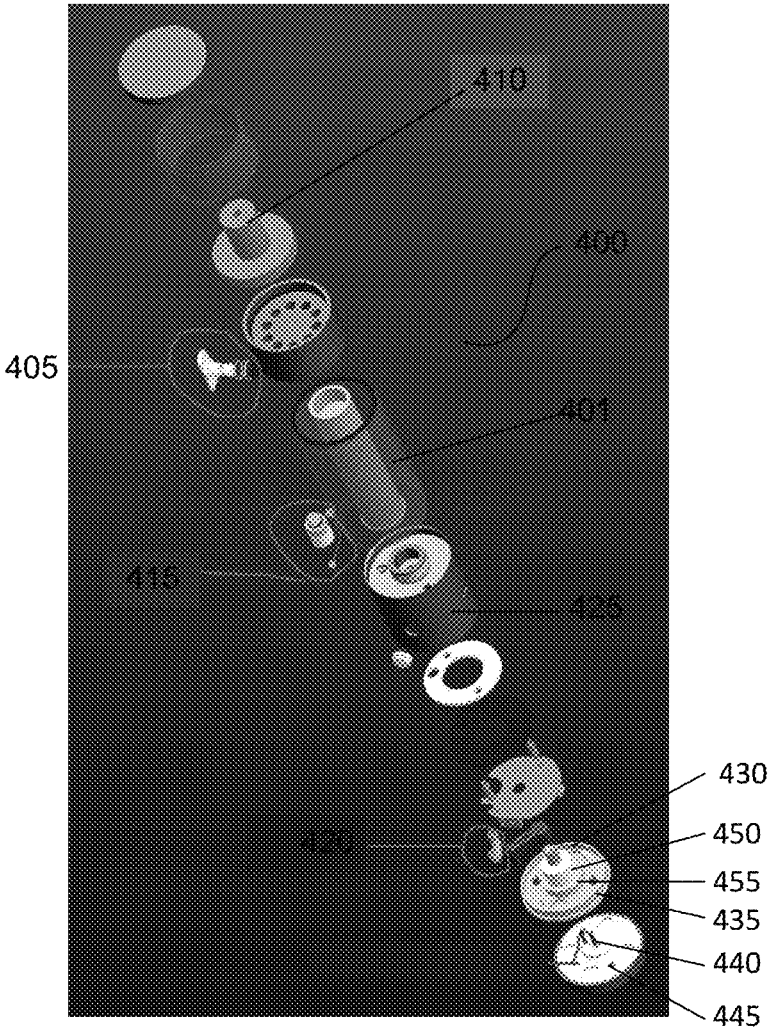
FIG. 4 is an exploded view of an exemplary inhalation device with an anti-leak water filter system, in accordance with an embodiment of the present invention.

FIG. 4 is an exploded view of an exemplary portable inhalation device 400 with an anti-leak water filter system, in accordance with an embodiment of the present invention. Inhalation device 400 may be configured as a vaporizing device or a direct burn device. In the present embodiment, inhalation device 400 may comprise a chamber filled with smoke filtering material or a water filled chamber 401 through which smoke or vapor may be filtered before inhalation. In an alternative embodiment, the smoke or vapor may be unfiltered. A top valve 405 may be released when a mouthpiece 410 is put in place over top valve 405. Top valve 405 may help seal the top of chamber 401 when inhalation device 400 is not in use. In the present embodiment, a one-way valve 415 near the bottom of chamber 401 may function similarly to one-way valve 301 illustrated by way of example in FIG. 3, may help ensure that water does not escape through the bottom of chamber 401 while still enabling smoke or vapor to pass from heating or burning chamber 425 to chamber 401 when a user is inhaling. Alternate embodiments may comprise a tube made of a rigid material and may be implemented without a spring in the tube. In the present embodiment, stirring component 440 may be a U-shaped hook that may be connected to actuator 445, which may be a rotating bottom or base portion of inhalation device 400, so that stirring component 440 may turn when actuator 445 is turned. The turning of stirring component 440 may cause any substance within heating compartment 450 to be stirred and redistributed throughout heating compartment 450 so that different portions of the substance in heating compartment 450 may be vaporized, heated or burned uniformly. Heating compartment 450 comprises heating base plate 455 and heating rod 430. The combination of heating base plate 455 and heating rod 430 generally provides more heat for heating or burning surface area 435 that is holding the substance than a base plate or heating rod alone. In an alternative embodiment, only heating base plate 455 or heating rod 430 may provide heat for the heating or burning surface area 435. Smoke or vapor from heating or burning compartment 425 may travel up into chamber 401 which may contain air and/or liquid. One-way valve 415 may enable the smoke or vapor to enter chamber 401 and substantially prevents the contents of chamber 401 from coming back down into heating or burning and containment chamber 425. In additional embodiments, one-way valve 301, illustrated by way of example in FIG. 3, may be integrated, as interchangeable component, in place of, or in addition to one-way valve 415, to help ensure that water does not escape through the bottom of chamber 401 while still enabling smoke or vapor to pass from heating or burning and containment chamber 425 to chamber 401 when a user is inhaling.

Those skilled in the art will readily recognize, in light of and in accordance with the teachings of the present invention that a multiplicity of suitable alternate and additional features may be provided in some embodiments. For example, without limitation, some embodiments may comprise magnetic interchangeable chambers that may enable the inhalation device to be converted for different types of materials and substances or burning methods such as, but not limited to, dry herb direct burning, dry herb vaporization, heating or burning of wax in various forms, oil vaporization, ointment vaporization, etc. Some of these embodiments may comprise means for automatically detecting which chamber is installed to help determine the proper burning temperature. In some embodiments, the chamber may be configured to provide a metered inhalation device. Some embodiments may comprise a built in grinder and dry herb storage area so that dry herbs may be stored in the device in larger pieces and, when needed, ground into smaller more easily burned pieces.

Figure 5A:
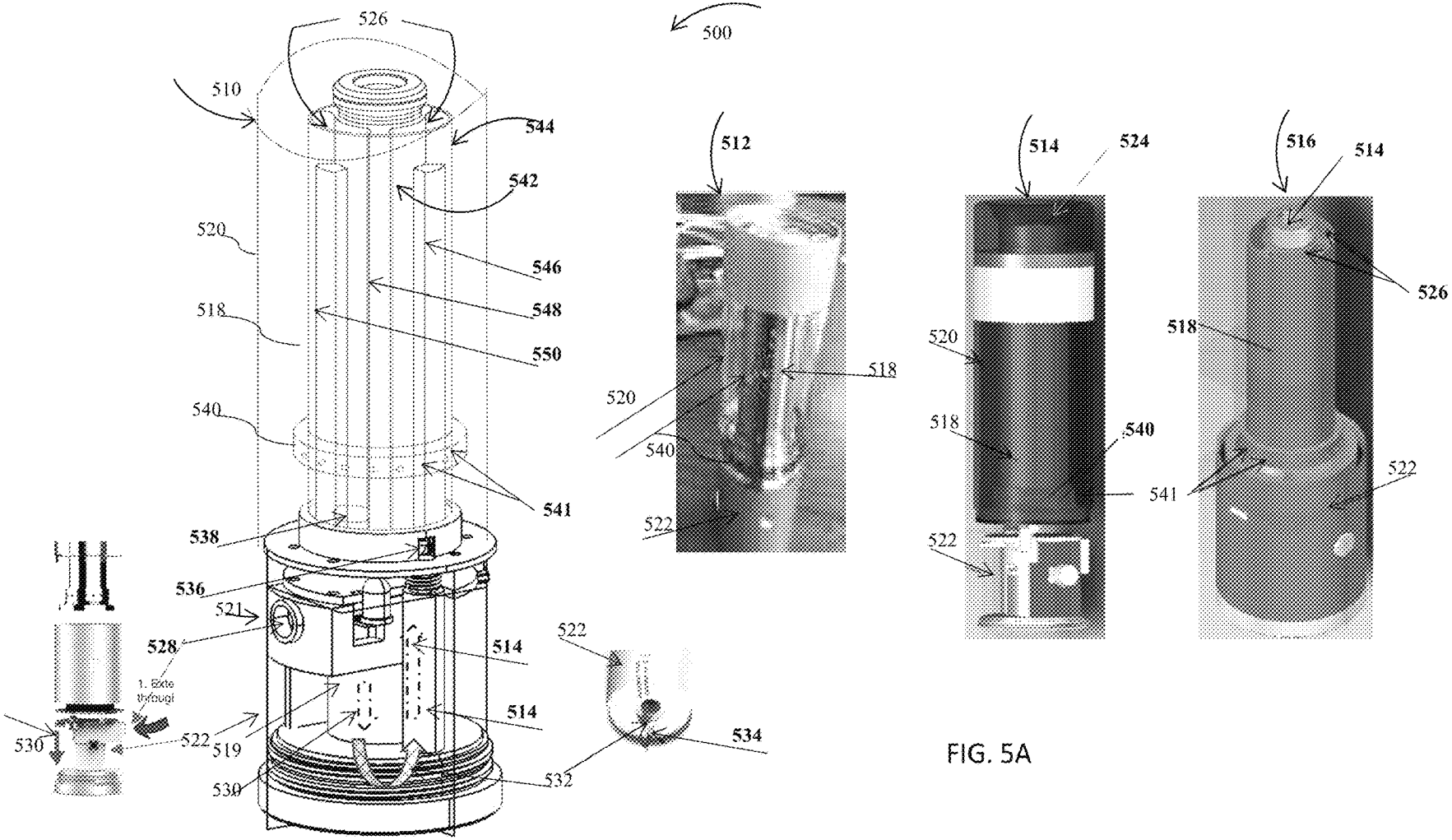
FIGS. 5A through 5D illustrate an exemplary leak minimizing air flow device for a water filtered inhalation device, in accordance with an embodiment of the present invention.
Figure 5B:
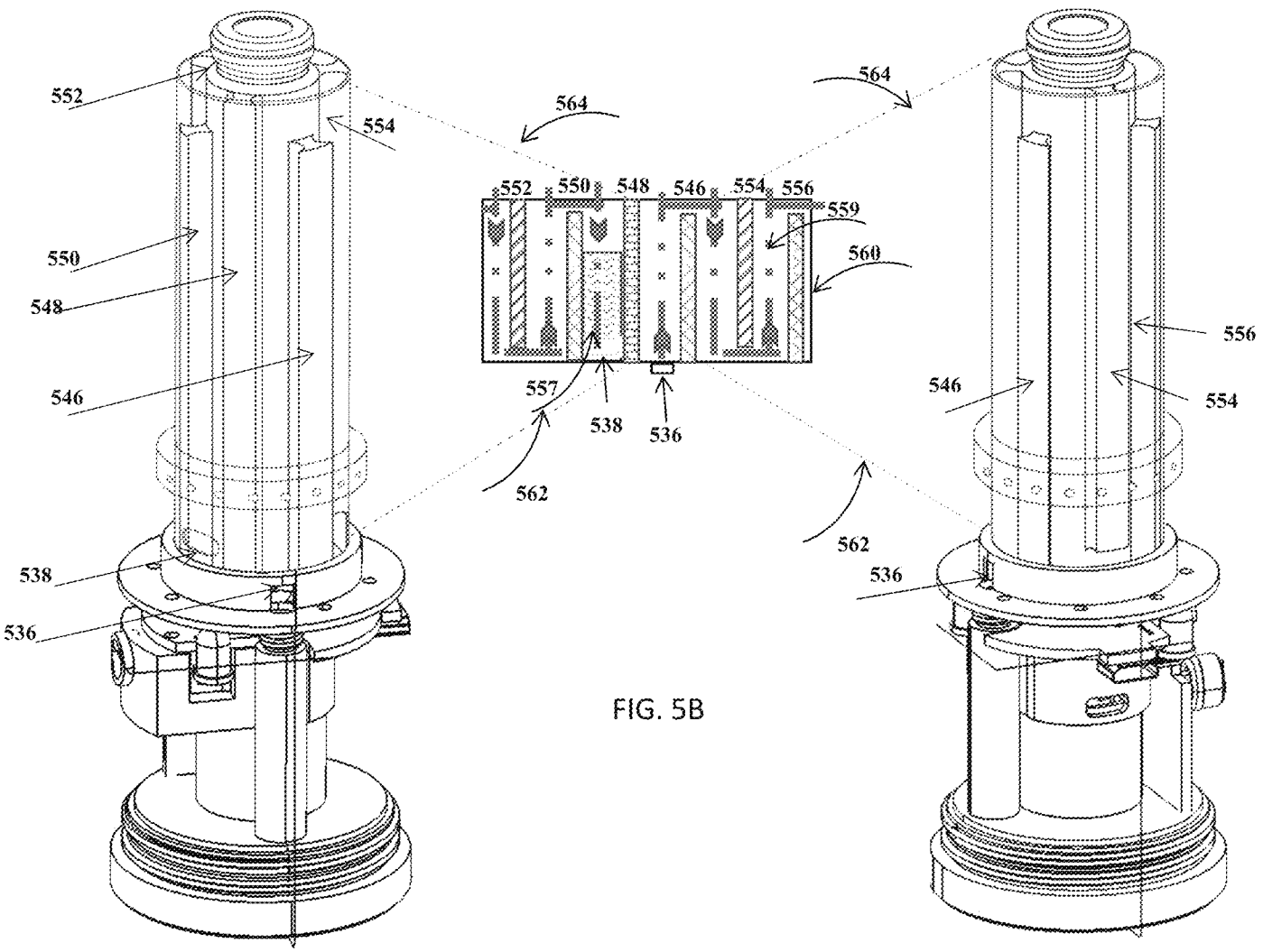
Figure 5C:
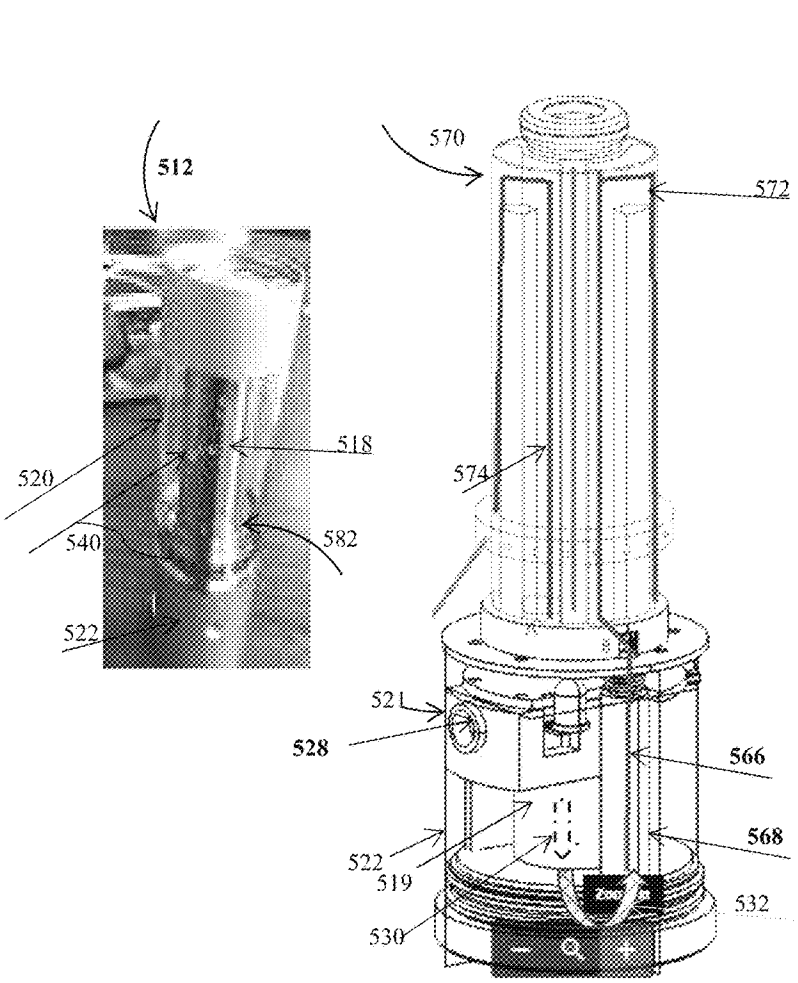
Figure 5C:
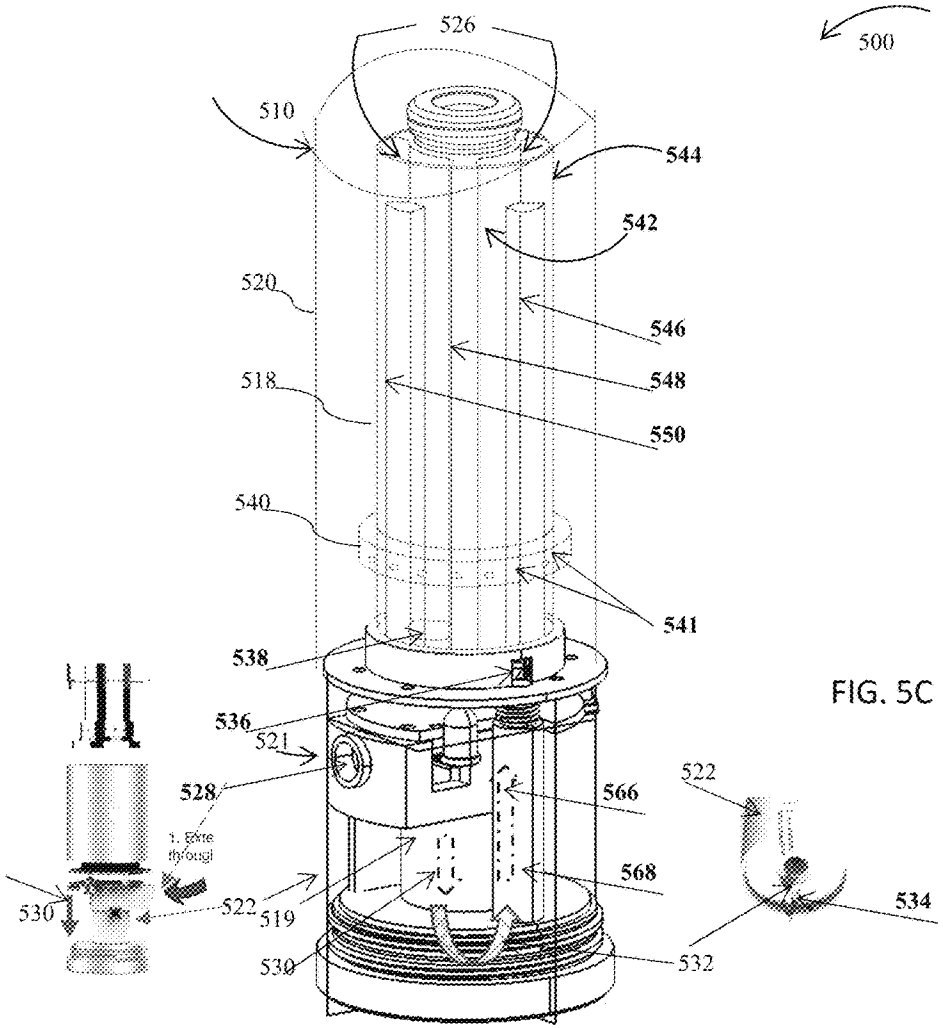
Figure 5D:
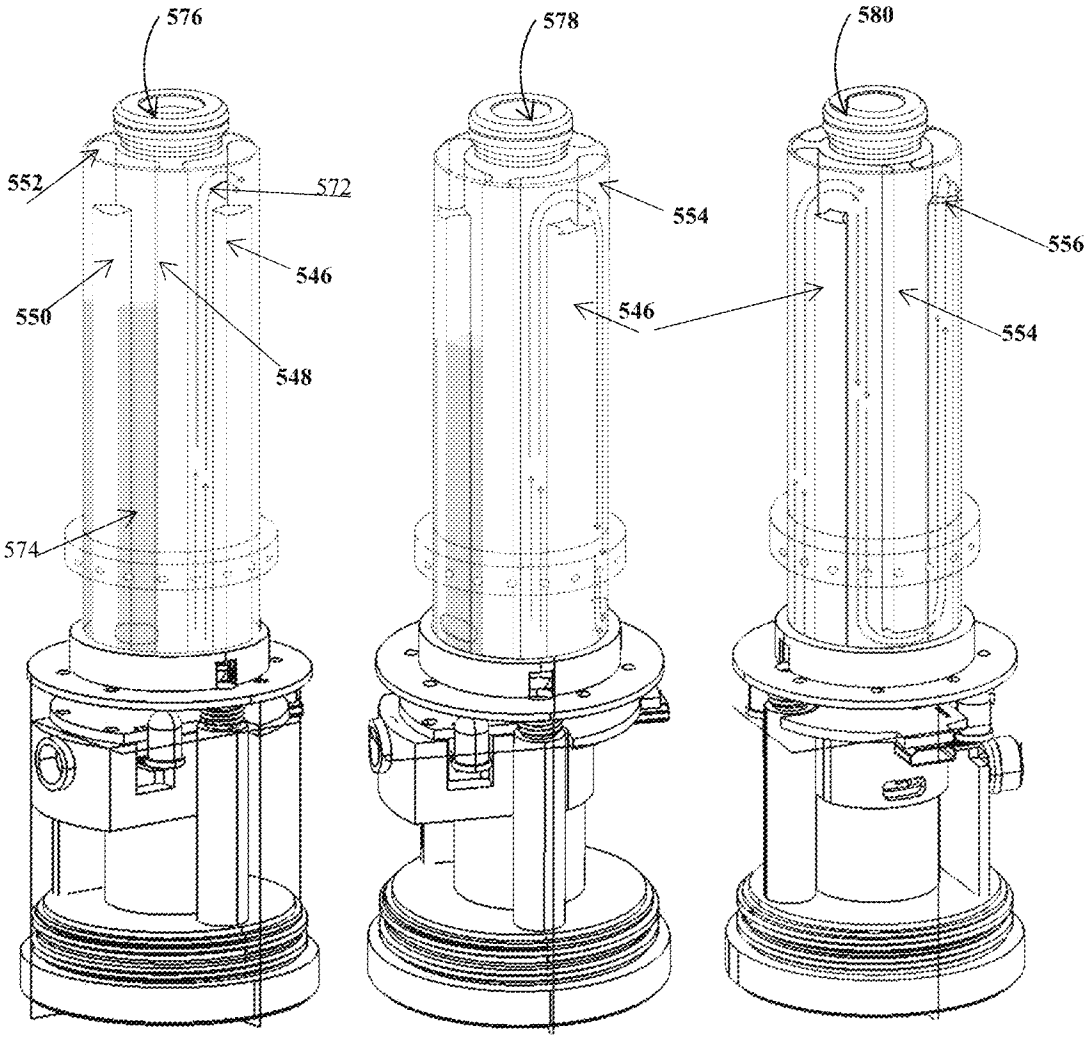

FIGS. 5A through 5G illustrate an exemplary water filtered inhalation device 500, in accordance with an embodiment of the present invention. FIG. 5A includes multiple views of the water filtered inhalation device 500. View 510 is a transparent front perspective view of the water filtered inhalation device 500. View 512 is an image of the front view of the water filtered inhalation device 500. Views 514 and 516 each are a solid front perspective view of the water filtered inhalation device 500. FIG. 5B is a front perspective view and a cut out view of the air flow chamber. FIG. 5C illustrates a perspective view showing the working of the airflow chamber, and FIG. 5D illustrates a perspective view showing the working of the airflow chamber. As shown in views 510, 512, 514, and 516 the water filtered inhalation device 500 may include an airflow chamber 518, a water chamber (an outer transparent cylindrical cover) 520 encircling the airflow chamber 518, a lower portion 519 including a vaporization chamber 522 (at times referred to as combustion or heating chamber), and a mouth piece 524. On a portion 521 of a surface of the lower portion 522 is present a side vent 528 for entry of external air. The air flow chamber 518 may include an air/vapor entry port 536 and a water entry/filtered air exit port 538. In one embodiment, there may be provided a ring 540 with a plurality of holes 541, that may cover the water entry/air exit port 538, as shown in views 512, 514, and 516. The air flow chamber may include two concentric tubes 542 and 544. The inner tube 542 may include the battery (not shown in figure) to supply power to the water filtered inhalation device 500. The air flow chamber 518 may be divided into a plurality of compartments 526. In one exemplary embodiment, the air flow chamber 518 may be divided into six compartments using six dividers of which three dividers 546, 548, and 550 are shown in view 510 laid out between an outer surface of the inside tube 542 and an inner surface of outside tube 544. In one embodiment, the concentric tubes 542 and 544 and the dividers may form an integral structure forming the air flow chamber 518. The design and layout of the dividers are provided in FIG. 5B. Assuming that the inner cylinder is cut open along its length and laid out 560 with the dividers 546, 548, 550, 552, 554, and 556 facing upwards, the dividers 552 and 554 may be disposed such that the dividers touch the top edge 564 of the air flow chamber 518; the dividers 550, 546, and 556 may be disposed such that the dividers touch the lower edge 562 of the air flow chamber 518; and divider 548 may be disposed such that the divider touches both the upper edge 564 and the lower edge 562 of the air flow chamber 518. The dividers may connect the inner surface of the outer tube and seals the outer surface of the inner tube with a water and air tight silicon seal. In one embodiment, the dividers are so lay out that they form a snake like tunnel 559 for the path of airflow through the air flow chamber 518.

During a typical working of the water filtered inhalation device 500, referring to FIG. 5C, external air may enter through the side vent 528. The air (mixed with the vapors of the herb or other material placed in the vaporization chamber 522) may then pass downward 530 through the vaporization chamber 522, and the air may leave the vaporization chamber through a bottom hole 532 and pass upward 566 through tube 568 into the air flow chamber 518 through the air flow vent 536 that connects the tube 568 and the air flow chamber 518. The air follows the path 572 as shown in view 570 and may snake through the gaps between the dividers.

Referring to FIG. 5D the air follows the path 572 as shown in views 576, 578, and 580, between the dividers 548, 546, 554, 556, 552, and 550 before exiting through filtered air exit port 538. i.e., air may have to travel 559 three times up and three times down between the compartments 526 before reaching the water 557 and exiting from the filtered air exit port 538. Referring to view 512 in FIG. 5C, water 582 for filtration may be provided in the space between the water chamber 520 and the air flow chamber 518. The water 582 may enter the air flow chamber 518 through the water entry port 538 and may fill the space between dividers 550 and 548. As mentioned above the divider 548 is connected both to the top edge and the bottom edge of the air flow chamber 518. Accordingly, the air follows a path as described herein 572 above and the water follows path 574 and fills the space between dividers 548 and 550. It may be appreciated by a person with ordinary skill in the art, in light of and in accordance with the teachings of the present invention, that the amount of water used for filtration may be such that it may be sufficient to enter through the water entry port 538 raise to a height to fill the space between the dividers 548 and 550 but not sufficient enough to follow the path and flow over and fill the gaps between dividers 550 and 552, i.e., not sufficient enough to follow the opposite path of the flow of air and reach the air entry port 536. Accordingly, in one embodiment, the flow of water used for filtration may be contained in the device 500 in a manner such that it may not leak out or spill into the vaporization chamber 522 through air entry port 536. In the exemplary embodiment, shown in FIG. 5A to 5D the air flow path 572 formed between the compartments 526 in the air flow chamber 518 is open so that air and heated gas may flow up and down freely during inhalation. It may be appreciated by a person with ordinary skill in the art, in light of and in accordance with the teachings of the present invention that if the water filtered inhalation device 500, were to be intentionally turned upside down multiple number of times, in the exemplary embodiment described herein at least six times, it may be possible that a very small amount of water may escape into the space between the rest of the dividers i.e., the dividers 550, 552, 556, 554, 546, and 548 and reach the air entry port 536. It may be appreciated by a person with ordinary skill in the art, in light of and in accordance with the teachings of the present invention that water may leak or follow the path opposite to air only if the water filtered inhalation device 500 may be accidentally or intentionally mishandled. i.e., for the water to leak into vaporization chamber 522, the water may need to travel up and down through the air flow path 572 in a direction opposite to the air flow path 572 through compartments 526 multiple times. Since gravity may act to impel the water to move in a downward direction, the water flow in a direction opposite to air flow may occur only if a user shakes the water filtered inhalation device 500 up and down or turns inhalation device upside down and then right side up multiple times. A user may not engage in such an activity during normal usage/working of the water filtered inhalation device. Even if a user shakes or rotates the water filtered inhalation device 500 up and down, the amount of water that may travel through all the tunnels of air flow chamber 522 and reach the vaporization chamber 522 may be negligible. In certain instances, water, may leak into the vaporization chamber 522 if a user may blow into the mouthpiece 524 instead of inhaling from the mouthpiece 524, which may not be considered as a normal usage of the water filtered inhalation device 500.

In an exemplary embodiment disclosed herein the transparent outer chamber 520 containing the water 582 and vaporization chamber 522 may form an integrated device and may be inseparable. In certain embodiments, the transparent outer chamber 520 containing the water 582 and vaporization chamber 522 may be separate pieces that are fixed together. In the present embodiment, combustion or vaporization chamber 522 may be electronically heated to produce a heated gas from a substance being burned or vaporized in the vaporization chamber 522.

The mouthpiece 524 on top of air flow chamber 518 may seal and connect the upper edge 564 of the air flow chamber 518, thus forming the air flow path/passage 572 that allows the air to enter at air entry port 536 and move in a snake like manner between channels formed between the dividers, before coming into contact with water for filtration and exiting from the filtered air exit port 536. It may be appreciated by a person with ordinary skill in the art, in light of and in accordance with the teachings of the present invention that the tunnels of the air passage in some alternate embodiments may implement different configurations that may minimize leakage, such as, but not limited to, spiral configurations, zigzag configurations, and stepped configurations.

In the present embodiment, a ring 540 containing multiple small holes 541 may be located at the top of the vaporization chamber 522 where air flow chamber 518 is joined with the vaporization chamber 522. The ring may be placed over the i.e., covering the, water entry port/filtered air exit port 538. The vapor from the vaporization chamber 522 interacts with the water in the water chamber 520 in the portion filled with water between the dividers in the air flow chamber 518 before exiting out of the filtered air exit port 538. While exiting the exit port 538 the vapor may bubble through the water. In the embodiment, were the ring 540 is provided, the inclusion of multiple holes 541 in the ring 540 may allow for more bubbling, more even exposure to the water for the heated gas exiting the vaporization chamber 522, increased air flow, and better filtration to occur within the water chamber 520 than would occur with the water exiting from a single port 538. The multiple small holes 541 may contain a spacing shaped like a "[" i.e., a square bracket, which may allow the air to travel below the ring through the entire ring.

Accordingly, in typical use of the water filtered inhalation device 500, in one embodiment, a user may inhale through the mouthpiece 524. Air may flow into the vaporization chamber 522 through side vent 528. The air is mixed with heated gas from the substance being heated in the vaporization chamber 522. A gas mixture comprising the air and heated gas may then enter the air flow chamber 522 through port 536 as described hereinabove. The air may then follow path 572 and travel through the compartments 526 to port 538. The gas mixture may escape through holes 541 into the water 582 near the bottom of the water chamber 540 and travels through the water for filtration. Then a user may inhale the gas mixture through mouthpiece 524.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing enhanced means for heat distribution for direct burn and vaporization of dry herbs and other substances according to the present invention will be apparent to those skilled in the art. Various aspects of the invention have been described above by way of illustration, and the specific embodiments disclosed are not intended to limit the invention to the particular forms disclosed. The particular implementation of the means for heat distribution may vary depending upon the particular context or application. By way of example, and not limitation, the means for heat distribution described in the foregoing were principally directed to inhalation device implementations; however, similar techniques may instead be applied to potpourri or wax warmers used to provide fragrance, humidifiers, or medical vaporizers, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A device comprising:

a vaporization chamber, wherein the vaporization chamber is configured to be substantially enclosed during operation and operable for containing a substance for vaporization;

a water chamber; wherein the water chamber is connected to the vaporization chamber; and a mouthpiece for inhaling smoke or vapor an air flow chamber, herein the air flow chamber connects the vaporization chamber, wherein the air flow chamber is configured to provide a tunnel between an upper edge and a lower edge of the air flow chamber, for passage of air/vapor from an air/vapor entry port to a filtered air exit port for air/vapor at the water chamber, in a non-linear manner; wherein the air/vapor entry port is located at a point where the vaporization chamber is joined to the water chamber;

wherein the air flow chamber is configured to prevent leakage of water from the water chamber to the vaporization chamber; and wherein the mouthpiece is placed on the top of the device, wherein the mouthpiece is configured to seal and connect the upper edge of the air flow chamber to form an air flow passage.

2. The device of claim 1, comprising a stirring component, said stirring component being configured to be operable for generally distributing the substance for vaporization substantially within said vaporization chamber for more even heating or burning thereof.

3. The device of claim 1, comprising a valve near the mouthpiece to trap excess smoke or vapor in a sealed chamber above the vaporization chamber.

4. The device of claim 1, wherein the air flow passage comprises a straight, spiral, zigzag, or stepped configuration.

5. The device of claim 1, wherein a ring containing multiple small holes is located at the top of the vaporization chamber where the air flow chamber connects to the vaporization chamber, wherein the ring covers the filtered air exit port.

6. The device of claim 5, wherein the ring contains a spacing shaped like a "[" i.e., a square bracket, configured to allow the air/vapor to travel below the ring through the entire ring, and exit as bubbles through the water in the water chamber.

7. The device of claim 1, wherein said device is a direct burn inhalation device, and the substance is a dried herb.

8. The device of claim 1, wherein said device is a vaporizing inhalation device, and the substance is oil or ointment.

9. The device of claim 1, comprising an air duct configured to enable air to enter the vaporization chamber and to assist in the burning of the substance.

10. The device of claim 1, comprising a heating or burning rod in the vaporization chamber.

11. The device of claim 1, comprising a stirrer in the vaporization chamber.

12. An inhalation device comprising:

means for inhaling smoke or vapor;

means for filtering the smoke or vapor before inhalation;

means for containing a substance, wherein the means is a vaporization chamber; means for heating or burning the substance contained within said containing means to produce the smoke or vapor;

means for stirring and redistributing the substance in said containing means; and means for passing the smoke or vapor in one direction from said containing means to said filtering means;

means for preventing the water from leaking into the vaporization chamber comprising:

an air flow chamber configured to provide a tunnel between an upper edge and a lower edge of the air flow chamber, for passage of air/vapor from an air/vapor entry port to a filtered air exit port for air/vapor at the water chamber, in a non-linear manner; wherein the air/vapor entry port is located at a point where the vaporization chamber is joined to the water chamber;

wherein a ring containing multiple small holes is located at the top of the vaporization chamber where the air flow chamber connects to the vaporization chamber, wherein the ring covers the filtered air exit port.

13. The device of claim 12, wherein the means for inhaling smoke or vapor comprises an air flow passage, wherein the air flow passage comprises a straight, spiral, zigzag, or stepped configuration.

14. The device of claim 12, wherein the ring contains a spacing shaped like a "[" i.e., a square bracket, configured to allow the air/vapor to travel below the ring through the entire ring, and exit as bubbles through the water in the water chamber.

15. An inhalation device comprising:

a vaporization chamber that is configured to hold a substance for heating or burning, wherein said vaporization chamber comprising:

a heating or burning plate configured to heat or burn the substance within said vaporization chamber;

means for an external stirring component configured to redistribute the substance in a vaporization chamber for even heating or burning; and means for turning said stirring means;

an air flow chamber, herein the air flow chamber connects the vaporization chamber, wherein the air flow chamber is configured to provide a tunnel between an upper edge and a lower edge of the air flow chamber, for passage of air/vapor from an air/vapor entry port to a filtered air exit port for air/vapor at the water chamber, in a non-linear manner; wherein the air/vapor entry port is located at a point where the vaporization chamber is joined to the water chamber; and wherein the air flow chamber is configured to prevent leakage of water from the water chamber to the vaporization chamber; and a mouthpiece for inhaling the smoke or vapor produced from the heated or burned substance.

16. The device of claim 15, wherein the mouthpiece is configured to seal and connect the upper edge of the air flow chamber to form an air flow passage, wherein the air flow passage comprises a straight, spiral, zigzag, or stepped configuration.

17. The device of claim 15, wherein a ring containing multiple small holes is located at the top of the vaporization chamber where the air flow chamber connects to the vaporization chamber, wherein the ring covers the filtered air exit port.

18. The device of claim 17, wherein the ring contains a spacing shaped like a square bracket, configured to allow the air/vapor to travel below the ring through the entire ring, and exit as bubbles through the water in the water chamber.

19. A device comprising:

a vaporization chamber, wherein said vaporization chamber is configured to be substantially enclosed during operation and operable for containing a substance for vaporization, and wherein said vaporization chamber comprises a heating element, which heating is configured to be operable for vaporizing a combustible substance placed inside said vaporization chamber;

a stirring component configured to be externally operable for generally distributing the combustible substance for more even heating or burning in said vaporization chamber;

a mouthpiece for inhaling smoke or vapor; and a valve near the mouthpiece to trap excess smoke or vapor in a sealed chamber above the vaporization chamber.

* * * * *